US008731419B2

(12) United States Patent
Kato et al.

(10) Patent No.: US 8,731,419 B2
(45) Date of Patent: May 20, 2014

(54) IMAGE FORMING APPARATUS AND IMAGE DENSITY CONTROL METHOD

(75) Inventors: Yuji Kato, Kanagawa (JP); Tsutomu Kato, Kanagawa (JP); Yohhei Watanabe, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 245 days.

(21) Appl. No.: 13/413,055

(22) Filed: Mar. 6, 2012

(65) Prior Publication Data

US 2012/0237233 A1 Sep. 20, 2012

(30) Foreign Application Priority Data

Mar. 16, 2011 (JP) ..... 2011-058344

(51) Int. Cl.
*G03G 15/00* (2006.01)
*G03G 15/16* (2006.01)
*G03G 15/01* (2006.01)

(52) U.S. Cl.
CPC ..... *G03G 15/5054* (2013.01); *G06G 15/5058* (2013.01); *G03G 2215/00059* (2013.01); *G03G 15/162* (2013.01); *G03G 15/0131* (2013.01)
USPC ..... 399/49

(58) Field of Classification Search
CPC ..... G03G 15/5054; G03G 15/5058; G03G 2215/00059; G03G 15/162; G03G 15/0131
USPC ..... 399/49
See application file for complete search history.

(56) References Cited

U.S. PATENT DOCUMENTS

| | | | | |
|---|---|---|---|---|
| 5,625,857 | A * | 4/1997 | Shimada et al. | 399/49 |
| 5,842,080 | A * | 11/1998 | Ashibe et al. | 399/49 |
| 5,950,062 | A | 9/1999 | Yahata et al. | |
| 7,158,730 | B2 | 1/2007 | Watanabe et al. | |
| 7,274,897 | B2 | 9/2007 | Katoh | |
| 7,302,208 | B2 | 11/2007 | Tsuda et al. | |
| 7,493,061 | B2 | 2/2009 | Hatori et al. | |
| 7,499,665 | B2 | 3/2009 | Kuma et al. | |
| 7,509,073 | B2 | 3/2009 | Katoh et al. | |
| 7,522,850 | B2 | 4/2009 | Watanabe et al. | |
| 7,609,998 | B2 | 10/2009 | Katoh et al. | |

(Continued)

FOREIGN PATENT DOCUMENTS

JP 2010-044098 A 2/2010

*Primary Examiner* — David Gray
*Assistant Examiner* — Tyler Hardman
(74) *Attorney, Agent, or Firm* — Harness, Dickey & Pierce, P.L.C.

(57) ABSTRACT

An image forming apparatus including an image carrier; an intermediate transfer member having a first portion and a second portion that has a higher glossiness than that of the first portion; a primary transfer member; a light source to emit light to the intermediate transfer member side; a detector to detect intensity of reflected light emitted from the light source and then reflected from the intermediate transfer member and a density adjustment pattern formed on the intermediate transfer member; a processor including a light-emission intensity adjuster to adjust light-emission intensity from the light source based on detected intensity of light reflected from the second portion of the intermediate transfer member; and an image forming condition controller to control image forming conditions for forming a toner image based on the detected intensity of the light reflected from the density adjustment pattern formed on the intermediate transfer member.

18 Claims, 5 Drawing Sheets

(56) References Cited

U.S. PATENT DOCUMENTS

| | | | | |
|---|---|---|---|---|
| 7,627,268 | B2 | 12/2009 | Katoh et al. | |
| 7,848,692 | B2 | 12/2010 | Saeki et al. | |
| 7,885,588 | B2 | 2/2011 | Katoh et al. | |
| 7,899,386 | B2 | 3/2011 | Saeki et al. | |
| 7,933,546 | B2 | 4/2011 | Fukao et al. | |
| 2005/0169667 | A1 | 8/2005 | Katoh | |
| 2006/0045570 | A1 | 3/2006 | Kato et al. | |
| 2006/0045603 | A1 | 3/2006 | Hatori et al. | |
| 2006/0210307 | A1 | 9/2006 | Katoh et al. | |
| 2006/0210324 | A1 | 9/2006 | Kuma et al. | |
| 2006/0284958 | A1 | 12/2006 | Saeki et al. | |
| 2007/0071499 | A1 | 3/2007 | Watanabe et al. | |
| 2007/0098472 | A1 | 5/2007 | Saeki et al. | |
| 2007/0127947 | A1 | 6/2007 | Kuma et al. | |
| 2007/0127955 | A1 | 6/2007 | Katoh et al. | |
| 2007/0248391 | A1 | 10/2007 | Yokokawa et al. | |
| 2007/0286640 | A1 | 12/2007 | Katoh et al. | |
| 2008/0145102 | A1 | 6/2008 | Katoh et al. | |
| 2008/0175619 | A1 | 7/2008 | Katoh et al. | |
| 2008/0199193 | A1* | 8/2008 | Nakazato et al. | 399/49 |
| 2009/0169236 | A1 | 7/2009 | Fukao et al. | |
| 2009/0279906 | A1 | 11/2009 | Kuma et al. | |
| 2009/0317104 | A1 | 12/2009 | Katoh et al. | |
| 2010/0040386 | A1 | 2/2010 | Mizutani et al. | |
| 2010/0061752 | A1 | 3/2010 | Sudo et al. | |
| 2011/0103862 | A1 | 5/2011 | Saeki et al. | |
| 2011/0222938 | A1 | 9/2011 | Watanabe et al. | |
| 2011/0311245 | A1* | 12/2011 | Inada et al. | 399/31 |

* cited by examiner

IMAGE FORMING APPARATUS AND IMAGE DENSITY CONTROL METHOD

CROSS-REFERENCE TO RELATED APPLICATION

This patent application is based on and claims priority pursuant to 35 U.S.C. §119 to Japanese Patent Application No. 2011-058344, filed on Mar. 16, 2011 in the Japan Patent Office, the entire disclosure of which is hereby incorporated by reference herein.

BACKGROUND OF THE INVENTION

1. Technical Field

Exemplary aspects of this disclosure generally relate to an image forming apparatus and image density control method, the image forming apparatus, such as a copier, a printer, a facsimile machine, a plotter, or a multifunction machine capable of at least two of these functions, to detect an image on an intermediate transfer member and control density of the forming image.

2. Description of the Related Art

In image forming apparatuses, such as a copier, a printer, a facsimile machine, a plotter, or a multifunction machine capable of at least two of these functions, the density of formed images may fluctuate due to such factors as usage environment, fluctuation in the characteristics of image carriers (photoreceptors) and developer over time, and manufacturing inconsistencies in the image carriers and the developer.

In image forming apparatuses including an intermediate transfer member (belt) on which the image is transferred from the image carrier, so-called process control is performed by detecting an image (adjustment pattern) on the intermediate transfer member.

In this configuration, an image density adjustment pattern for adjusting the density of the image is formed on the intermediate transfer member, light is directed onto the image density adjustment pattern, light reflected from the image density adjustment pattern is detected by a reflection-type density sensor, and one or more image forming conditions are controlled so that readings from the reflection-type density sensor assume a desired output value.

In order to perform such control accurately, it is necessary to adjust the intensity of the light that is used to illuminate the image density adjustment pattern. Conventionally, this may be done by directing light onto a clear, background surface of the intermediate transfer member, the light reflected from the background surface is detected by the reflection-type density sensor, and the image forming conditions are adjusted so that the readings from the reflection-type density sensor assume a desired value.

However, the surface of the intermediate transfer member may not be very glossy due to limitations placed on the type of material that can be used for the intermediate transfer member by the need to transfer the image carried on the intermediate transfer member onto a transfer sheet. Moreover, the glossiness of the surface of the intermediate transfer member may decline as the surface of the intermediate transfer member deteriorates over time. In such cases, the readings from the reflection-type density sensor may become insufficient to adjust correctly the intensity of the light directed onto the image density adjustment pattern.

In order to solve this problem, JP-2010-44098-A discloses a reflection-type density sensor that is movable in a direction orthogonal to a direction in which the intermediate transfer member moves, in other words, is movable in a width direction of the intermediate transfer member. The readings from the intermediate transfer member are set to a value that is sufficient to execute the above-described adjustment by moving the density sensor. This case assumes that the degradation in glossiness appears as unevenness in the width direction of the intermediate transfer member when the glossiness of the surface of the intermediate transfer member deteriorates over time, in which case this adjustment is executed by moving the reflection-type density sensor toward a portion that remains glossy enough to enable such adjustment.

However, although generally effective for its intended purpose, the above-described configuration is ineffective in a case in which the surface of the intermediate transfer member is not very glossy to begin with due to the limitations placed on the material of the intermediate transfer member as described above, and as a result, the surface has insufficient glossiness to enable adjustment of the readings from the reflection-type density sensor. In addition, in a configuration in which the reflection-type density sensor is movable, such a configuration is complicated and costly, and hinders efforts to make the image forming apparatus more compact.

SUMMARY

In one aspect of this disclosure, there is provided an image forming apparatus to form a toner image onto a recoding medium, including an image carrier, an intermediate transfer member, a primary transfer member, a light source, a detector, and a processor. The image carrier bears the toner image and a density adjustment pattern for adjusting image density of the toner image. The intermediate transfer member on which the toner image and the density adjustment pattern are formed, has a first portion and a second portion, and the second portion has a higher glossiness than that of the first portion. The primary transfer member transfers the toner image and the density adjustment pattern from the image carrier onto the intermediate transfer member. The light source emits light onto the intermediate transfer member and the density adjustment pattern formed on the intermediate transfer member. The detector detects intensity of reflected light emitted from the light source and then reflected from the intermediate transfer member and the density adjustment pattern formed on the intermediate transfer member. The processor includes a light-emission intensity adjuster and an image forming condition controller. The light-emission intensity adjuster adjusts light-emission intensity of light emitted from the light source based on detected intensity of light reflected from the second portion of the intermediate transfer member. The image forming condition controller controls image forming conditions for forming the toner image based on the detected intensity of the light reflected from the density adjustment pattern formed on the intermediate transfer member.

In another aspect of this disclosure, there is provided an image density control method in an image forming apparatus including an image carrier, an intermediate transfer member having a first portion and a second portion that has higher glossiness than that of the first portion, a primary transfer member, a light source, a first detector, and a second detector. The image density control method including emitting light to the second portion of the intermediate transfer member, from the light source; detecting intensity of light reflected from the second portion of the intermediate transfer member by the first detector; adjusting light-emission intensity emitted from the light source based on the intensity of the light reflected from the second portion of the intermediate transfer member and detected by the first detector; forming a density adjustment pattern on the intermediate transfer member; emitting light onto the density adjustment pattern formed on the intermediate transfer member, from the light source; detecting intensity of light reflected from the density adjustment pattern formed on the intermediate transfer member by the second detector, after the light-emission intensity from the light source is adjusted; and adjusting image forming conditions to form a toner image on the image carrier based on the intensity of the light reflected from the density adjustment pattern formed on the intermediate transfer member and detected by the second detector.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
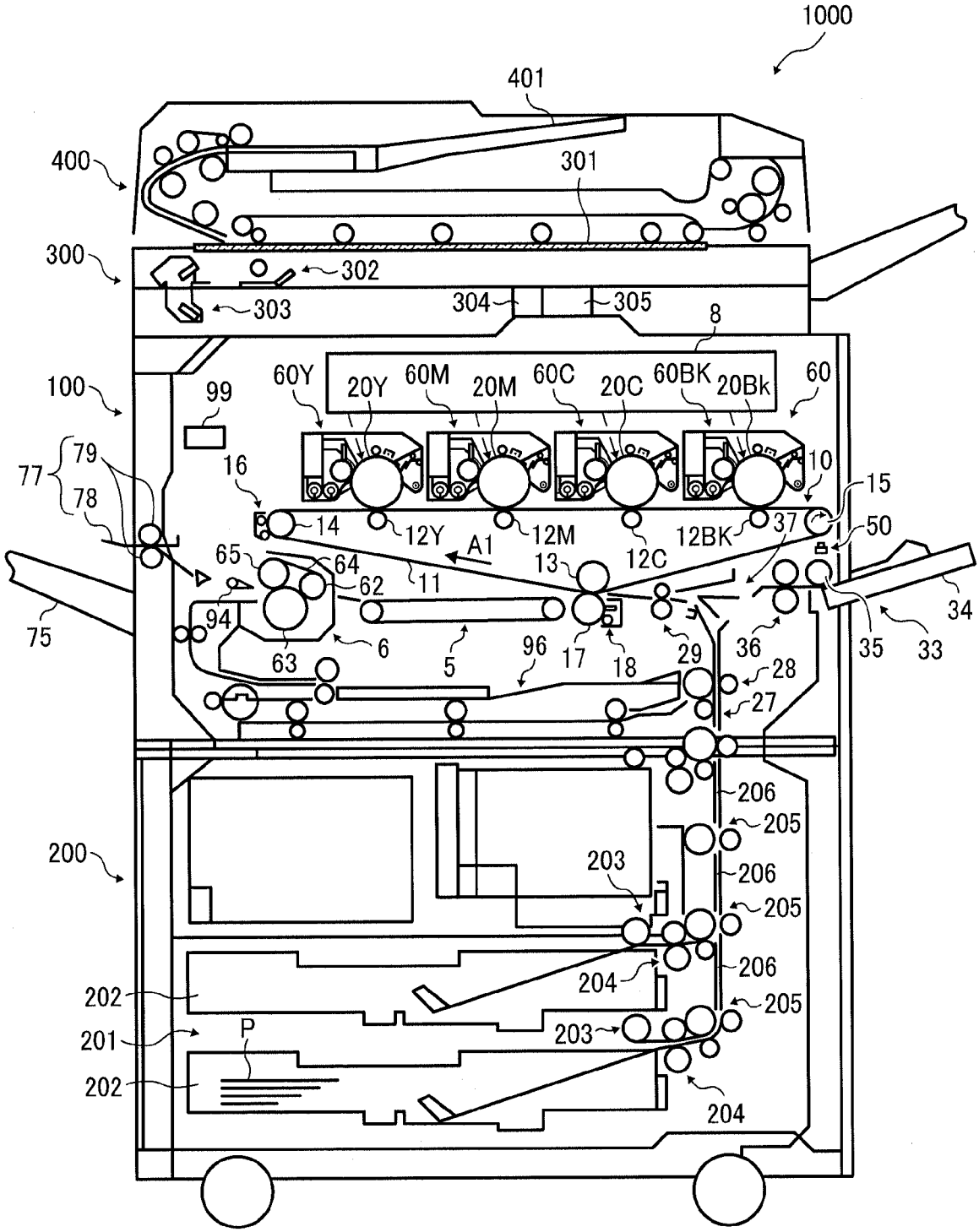
FIG. 1 is a schematic diagram illustrating an image forming apparatus according to an aspect of this disclosure.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result. Referring now to the drawings, wherein like reference numerals designate identical or corresponding parts throughout the several views thereof, and particularly to FIGS. 1 through 6, an electrophotographic image forming apparatus according to illustrative embodiments of the present disclosure is described.

FIG. 1 is a schematic diagram illustrating a tandem-type color copier as an example of the image forming apparatus 1000 according to an aspect of this disclosure. It is to be noted that the configuration of the present specification is not limited to that shown in FIG. 1. For example, the configuration of the present specification may be adapted to printers including an electrophotographic image forming device as well as other types of image forming apparatuses, such as copiers, facsimile machines, multifunction peripherals (MFP), and the like. When the image forming apparatus 1000 is used as the printer or the facsimile, an image forming process is executed based on image signal corresponding to image data received from outside.

In the image forming apparatus 1000 can for image onto recording media, for example, plain papers for using generally in copying, cardboard (e.g., card, and postcard), a sheet medium such as envelope, sheet type decal, etc. The image forming apparatus 1000 can select duplex printing in which the image are formed on both faces of the transfer sheet (recording medium), in addition to single-side printing.

Referring now to the drawings, wherein like reference numerals designate identical or corresponding parts throughout the several views, and initially with reference to FIG. 1, a description is provided of overall configuration and operation of an image forming apparatus according to an aspect of this disclosure.

In FIG. 1, the image forming apparatus 1000 includes an image forming body 100, a sheet feeding unit 200, a scanner 300, and an automatic document feeder (ADF) 400. The image forming body 100 serves as an image forming mechanism. The scanner 300 serves as an image reading mechanism and is disposed substantially above the image forming body 100. The ADF 400 is disposed substantially above the scanner 300. The sheet feeding unit 200 is disposed beneath the image forming body 100.

The image forming apparatus 1000 is a tandem type image forming apparatus using tandem structure in which four photoreceptor drums 20Y, 20M, 20C, and 20Bk form images for resolved respective colors yellow, magenta, cyan, and black, are arranged. A transfer belt 11 that is an endless belt is positioned in an almost center portion of the image forming body 100 of the image forming apparatus 1000. The photoreceptor drums 20Y, 20M, 20C, and 20Bk have identical diameters respectively, which are arranged outside of an outer periphery (image forming side) of the transfer belt 11 evenly spaced apart. The transfer belt 11 serves as an intermediate transfer member and the photoreceptor drums 20Y, 20M, 20C, and 20Bk serve as image carriers.

The transfer belt 11 is movable in a clockwise direction indicated by arrow A1 in FIG. 1, while contacting the respective photoreceptor drums 20Y, 20M, 20C, and 20Bk. A visualized image (toner image) formed and carried on the respective photoreceptor drums 20Y, 20M, 20C, and 20Bk are primary transferred therefrom and superimposed one on another on the transfer belt 11, and then the toner image is transferred onto a transfer sheet P. Thus, the image forming apparatus 1000 adapts indirectly transfer method (intermediate transfer method). That is, the image forming apparatus 1000 is a tandem-type indirectly-transfer electrophotographic device.

The image forming body 100 mainly includes an image forming section 60, an optical writing device 8, a transfer belt unit 10, a secondary transfer roller 17, and a fixing device 6. The image forming section 60 includes four image stations 60Y, 60M, 60C, and 60Bk. The transfer belt unit 10, serving as an intermediate transfer unit, includes the transfer belt 11, positioned beneath the respective photoreceptor drums 20Y, 20M, 20C, and 20Bk. The secondary transfer roller 17 is positioned facing the transfer belt 11 and is across the transfer belt 11 from the image forming section 6. The secondary transfer roller 17 serves as a secondary transfer member to secondary transfer the toner image on the transfer belt 11 onto the transfer sheet P in a contact position while rotating in the same direction as the transfer belt 11. A secondary-transfer cleaning device 18 to clean the secondary transfer roller 17 is positioned near the secondary transfer roller 17. A transport device 5 that is provided between the secondary transfer roller 17 and the fixing device 6 transports the transfer sheet P on which the toner image is transferred from the transfer belt 11 by the secondary transfer roller 17.

The optical writing device 8, serving as an exposure device, is positioned facing to and above the image stations 60Y, 60M, 60C, and 60Bk. In addition, the image forming body 100 includes a registration roller 29, a transport detector, a discharge device 77, and a sheet reverse mechanism 96. The registration rollers 29 stops feeding the transfer sheet P and then towards the transfer sheet P timed to coincide with the arrival of the multicolor toner image formed on the transfer belt 11. The transport detector detects the arrival of a leading edge of the transfer sheet P at the registration roller pair 29.

In the image forming body 100, the fixing device 6 fixes the toner image on the transfer sheet P when the transfer sheet P on which the toner image is transferred from the transfer belt 11 is conveyed to the fixing device 6 through the transport device 5. The discharge device 77 including a discharge path 78 and a discharge roller pair 79 discharges the transfer sheet P after fixing process outside of the image forming body 100 to a discharge sheet tray 75. The sheet reverse mechanism 96 is positioned beneath the discharge device 77, the transport device 5, the secondary transfer roller 17, and the secondary-transfer cleaning device 18, and is provided in parallel to the image forming section 60. In the duplex printing to record images on both sides of the transfer sheet P, after the transfer sheet P on which the image is formed on one face is transported from the discharge device 77 to the sheet reverse mechanism 96 by switching a switch pawl 94, the sheet reverse mechanism 96 switches back to reverse upside down, and then transports to the registration roller pair 29.

The image forming body 100 further includes a manual sheet device 33 positioned right side of the image forming body 100, a control panel to operate the image forming apparatus 1000, a processor 99 to control operation in the image forming apparatus 1000, and a waste toner tank.

The optical writing device 8 includes four laser light sources to emit light beams LY, LM, LC, and LBk as laser beams based on the image signal. By emitting light, the optical writing device 8 scans and exposes a surface (scanned surface) of the photoreceptor drums 20Y, 20M, 20C, and 20Bk and execute light writing process to form latent images thereon.

The image data, for example, the image of the document scanned by the scanner 300, the image of the receiving data from the facsimile, and the input image data input from the external input device (e.g., PC). The optical writing device 8 receives the image data, resolves the image data into respective color of the edition based on the image data, and generates electronic data (image signal) to be formed, corresponding to the respective color of the edition. The image signal is constituted by the respective color edition based on the image data. The optical writing device 8 converts the electronic data (image signal) into optical data as the laser beams LY, LM, LC, and LBk.

Driving in the light sources in the optical writing device 8 is controlled by the processor 99, and thus, the light sources emits the light beams LY, LM, LC, and LBk and these light beams (optical data) are fixed on the surfaces of the photoreceptor drums 20Y, 20M, 20C, and 20Bk as the latent images. It is to be noted that the light sources are not limited to the above-described lasers, alternatively, for example, the optical writing device 8 can use some other light sources, for example, light emission diode (LED).

Figure 2:
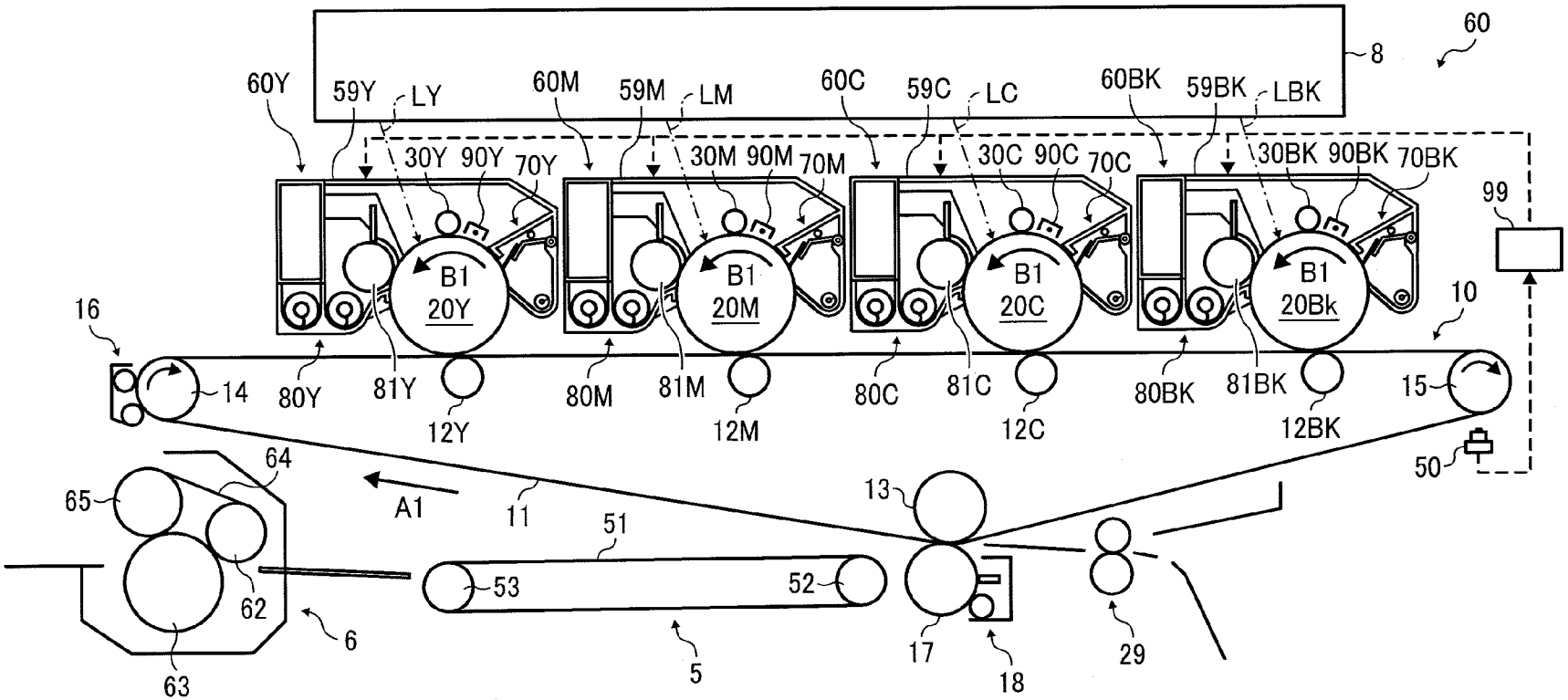
FIG. 2 is a diagram illustrating vicinities of an image forming section and a transfer belt unit in the image forming apparatus shown in FIG. 1.

As illustrated in FIG. 2, the transfer belt unit 10 further includes primary transfer rollers 12Y, 12M, 12C, and 12Bk, a driving roller 15, a driven roller (tension roller) 14, a secondary transfer facing roller 13, and a belt-cleaning device 16, in addition to the transfer belt 11. The primary transfer rollers 12Y, 12M, 12C, and 12Bk, positioned interior of a loop of the transfer belt 11, press the photoreceptor drums 20Y, 20M, 20C, and 20Bk. The primary transfer rollers 12Y, 12M, 12C, and 12Bk serve as primary transfer members (transfer chargers). The driving roller 15, the driven roller (tension roller) 14, the secondary transfer facing roller 13, functioning as support rollers, support the transfer belt 11 in a state in which the transfer belt 11 is inverted triangular shape. The belt-cleaning device 16 cleans a surface of the transfer belt 11 while the tension roller 14 and the belt-cleaning device 16 sandwich the transfer belt 11.

An optical sensor unit 50 that is a reflection-type density sensor is provided near the transfer belt unit 10. That is, the optical sensor units 50 is provide at a position located downstream from the image section 60 and upstream from the secondary transfer roller 17; more specifically, the optical sensor 50 is located at a position near the outer surface of the transfer belt 11 facing the driving roller 15. The optical sensor unit 50 optically detects the toner image formed on the transfer belt 11. A detector holder to hold the optical sensor unit 50 so that a predetermined distance is kept between the transfer belt 11 and the optical sensor unit 50 is provided near the transfer belt unit 10. A transfer unit driving mechanism to change states of the transfer belt 11 based on whether the multiple color image or monochrome (single color) image using only black is formed, is provided in the transfer belt unit 10. It is to be noted that the driving roller to rotate the transfer belt 11 may be constituted by the tension roller 14 or the secondary transfer facing roller 13. In this case, other rollers may function as the driven rollers.

When the multiple color image having at least two colors are executed, the belt unit driving mechanism controls the transfer belt 11 so that the respective photoreceptor drums 20Y, 20M, 20C, and 20Bk contact a horizontal upper surface of the transfer belt 11 (see FIG. 1). Conversely, when the monochrome image is formed, the belt unit driving mechanism moves a left side of the transfer belt 11 downward so that the transfer belt 11 is moved away from the photoreceptor drums 20Y, 20M, and 20C and the transfer belt 11 contacts the only black photoreceptor drum 20Bk. When the monochrome image is formed, the operation of the image stations 60Y, 60M, and 60C including rotation in the photoreceptor drums 20Y, 20M, and 20C is stopped. With this configuration, in both states, the image forming section 60 is positioned above a portion of the transfer belt 11 between the tension roller 14 and the driving roller 15.

It is preferable that the four image stations 60Y, 60M, 60C, and 60Bk are arranged in this order from upstream to downstream in the A1 direction, and below mentioned image forming is performed. Because, for the primary transfer process in superimposing and transferring image onto the transfer belt 11, the primary transfer rollers 12Y, 12M, 12C, and 12Bk are arranged in contact with an internal surface of the transfer belt 11 so that the respective rollers 12Y, 12M, 12C, and 12Bk face the photoreceptor drums 20Y, 20M, 20C, and 20Bk via the transfer belt 11. The primary transfer rollers 12Y, 12M, 12C, and 12Bk apply primary transfer voltage to the photoreceptor drums 20Y, 20M, 20C, and 20Bk via the transfer belt 11. By applying the primary transfer voltages to the transfer belt 11, the primary transfer roller 12Y, 12M, 12C, and 12Bk primary transfer in portions positioned just under the photoreceptor drums 20Y, 20M, 20C, and 20Bk at different times respectively from upstream side to the downstream side. Thus, while the transfer belt 11 is moved in the A1 direction, the toner images formed on the photoreceptor drums 20Y, 20M, 20C, and 20Bk are transferred onto the same portion of the transfer belt 11.

The photoreceptor drums 20Y, 20M, 20C, and 20Bk are arranged in this order from upstream to downstream in the A1 direction. The respective photoreceptor drums 20Y, 20M, 20C, and 20Bk are equipped with image stations 60Y, 60M, 60C, and 60Bk to form yellow, magenta, cyan, and black images, respectively. Herein, the order of forming images and arrangement of the image stations 60Y, 60M, 60C, and 60Bk are not limited to the above-described configuration but alternative orders and arrangements based on the target and characteristics in respective type of the image forming apparatus 1000.

Beneath the transfer belt unit 10, the secondary transfer roller 17 is provided. The secondary transfer roller 17 and the secondary transfer facing roller 13 sandwich the transfer belt 11. The secondary transfer facing roller 13 that is disposed opposite the secondary transfer roller 17 via the transfer belt 11 supports the transfer belt 11 from inside the loop opposite a belt surface of the transfer belt 11, thereby forming a secondary transfer nip. A secondary transfer bias whose polarity is opposite to that of the toner is applied to the secondary transfer nip, and a secondary transfer electric field to move electrostatically the maximum four color toner images beard on the transfer belt 11 to the secondary transfer roller 17 is formed in the secondary transfer nip. At this time, the transfer sheet P is conveyed to the secondary transfer nip between the secondary transfer belt 11 and the secondary transfer roller 17 by the registration roller 29. Then, the toner image is secondary transferred onto the transfer sheet P by the secondary transfer bias and nip pressure.

The belt-cleaning device 16 is positioned downstream from the secondary transfer nip in the A1 direction. In other words, the belt-cleaning device 16 cleans the transfer belt 11 at position upstream from the primary transfer roller 12Y that faces the most upstream photoreceptor drums 20Y in the photoreceptor drums 20Y, 20M, 20C, and 20Bk in the A1 direction.

The belt-cleaning device 16 includes a fur brush, a blade, a contact-separation mechanism, and a voltage applying device. The fur brush (brush roller) servers as a cleaning member to contact the transfer belt 11 and the blade contacts and cleans the fur brush. The contact-separation mechanism causes the fur brush to contact and separate from the transfer belt 11 at appropriate times. The voltage applying device applies a voltage to move the toner toward the fur brush. The fur brush is rotatable in opposite direction to a direction in which the transfer belt 11 is rotated. The fur brush in the belt-cleaning device 16 cleans the outer surface of the transfer belt 11 while the transfer belt 11 is rotated in the A1 direction, and the blade scraps off the toner attracted on the fur brush in the cleaning process.

The transfer device 5 includes a transport belt 51, a driving roller 52, a driven roller 53, and a power supply. An upper surface of the transport belt 51 transports the transfer sheet P. The transport belt 51 is wound around the driving roller 52 and the driven roller 53. The power supply supplies a driving voltage to the driving roller 52.

The fixing device 6 includes a heating roller 62, a pressing roller 63, a fixing belt 64, and a fixing roller 65. The heating roller 62 includes a heating source internally. The fixing belt 64 is wound around the heating roller 62 and the fixing roller 65. The pressing roller 63 and the fixing belt 64 meet and press against each other, thereby forming a fixing nip. The heating roller 62, the fixing belt 64, the fixing roller 65 function as a belt unit to move the fixing belt 64 seamlessly. The transfer sheet P is held in the fixing nip between the pressing roller 63 and the fixing belt 64 and supplied with pressure and heat. Accordingly, the composite toner image is fixed on the transfer sheet P, forming a color image thereon.

As illustrated in FIG. 1, after the fixing process, the transfer sheets P are discharged toward the discharge sheet tray 75 located outside of the image forming body 100 through the discharge path 78 by the discharging sheet roller pair 79 and are stacked on the discharge sheet tray 75. Alternatively, in the duplex printing, after the fixing process, the transfer sheets P are conveyed to the sheet reverse mechanism 96 by switching the switch pawl 94.

The sheet reverse mechanism 96 that reverses the transfer sheet P is provided beneath the secondary transfer roller 17 and the fixing device 6. The reverse mechanism 96 reverses the transfer sheet P and again sends the transfer sheet P to the registration roller 29 to print the images on both side of the transfer sheet P (duplex printing).

The sheet feeding unit 200 includes a paper bank 201 having one or more sheet cassettes 202 each accommodating multiple transfer sheets P and equipped with a sheet feed roller 203. The sheet feeding unit 200 also includes separation rollers 204 and sheet transport rollers 205. The sheet cassette 202 stores a stack of transfer sheets P. The sheet feed roller 203 picks up a top sheet from the stack of the transfer sheets P in the sheet cassette 202 and feeds it to the separation roller 204 that guides the transfer sheet P to a sheet feeding path 206. The sheet transport rollers 206 convey the transfer sheet P to a sheet conveyance path 27 of the image forming body 100.

The sheet feeding path 206 in the sheet feeding unit 200 is continuously connected to the sheet conveyance path 27 in the image forming body 100. The registration pair 29 is provided on downstream end of the sheet conveyance path 27. A sheet conveyance roller 28 is provided near the sheet conveyance path 27.

In the sheet feeding unit 200, when the sheet feed roller 203 is rotated in a counterclockwise direction shown in FIG. 1, and the separation roller 204 is activated, a top of the transfer sheet P is picked up and conveyed to the sheet feeding path 206. Then, the transfer sheet P is conveyed to the registration roller pair 29 through the sheet conveyance path 27 and skew is corrected by the registration roller pair 29.

Herein, the manual feeding device 33 includes a sheet tray 34 for manually feeding the transfer sheet P, a feed roller 35, and a separation roller 36. The transfer sheet P placed on the sheet tray 34 is supplied to a manual feeding path 37 one-by-one by the separation roller 36. The manual feeding path 37 merges the sheet conveyance path 27 in the image forming body 100.

In the manual feeding device 33, the feed roller 35 is rotated in a counterclockwise direction shown in FIG. 1, and the separation roller 36 is activated, a top of the transfer sheet P is picked up and conveyed to the manual feeding path 37. Then, the transfer sheet P is conveyed to the registration roller pair 29 through the manual feeding path 37 and skew is corrected by the registration roller pair 29.

The scanner 300 includes a contact glass 301 on which a document is placed, a first carriage 302 installing a light source for lighting the documents and a reflection minor, a second carriage 303 installing multiple reflection minors, a image focusing lens 304, and a reading sensor 305 disposed at a downstream position from the image focusing lens 304 in which a light from the light source travels. The scanner 300 scans image data on the document placed on the contact glass 301 while the second carriage 303 reciprocally moves. At this time, the scanning light emitted from the second carriage 303 is focused on a focusing face of the reading sensor 305 by the focusing lens 304 and then is read by the reading sensor 305 as an image signal.

The image data of the document scanned by the reading sensor 305 is transmitted to the processor 99. The processor 99, which is described further detail later, includes storage memory, such as a read only memory (ROM) and a random access memory (RAM). The ADF 400 automatically feeds the documents to a position where the document is scanned. The ADF 400 includes a document tray 401 on which the document is placed. The ADF 400 is rotatable to the scanner 300, and the contact glass 301 is exposed when the ADF 400 is opened to pivot upward.

A control panel (operation panel) is provided on a front side of the image forming apparatus 1000. The control panel includes a liquid crystal display and an operating portion (keypad) including various key buttons, for example, a start switch (copy start key) to start printing and numeric key to input printing numbers. Using the control panel, the user can designate whether multiple color image or monochrome image is formed and select whether the print mode is one-side printing on which the image is formed on one side of the transfer sheet P or the duplex printing. The one-side printing mode includes direct discharge mode, reversal discharge mode, and a reversal decal printing mode, and one of those mode is selected.

Each of the image stations (process units) 60Y, 60M, 60C, and 60Bk is removably installed in the image forming apparatus 100 of the image forming apparatus 1000. Each of the image stations 60Y, 60M, 60C, and 60Bk has the same basic configuration, differing only in the color of toner used therein as an image forming material. Using the image station 60Y purely as an example, the configuration of the image stations 60Y, 60M, 60C, and 60Bk is described in further detail below.

Referring to FIG. 2, the image station 60Y includes a drum cleaning device 70Y serving as a cleaner, a discharge device 90Y serving as a discharger, a charging device 30Y serving as a charging unit, and a development device 80Y, in addition to the photoreceptor drum 20Y. On the photoreceptor drum 20Y, the drum cleaning device 70Y, the discharge device 90Y, the charging device 30Y, and the development device 80Y are arranged in this order from the primary transfer roller 12Y in a direction in which the photoreceptor drum 20Y rotates indicated by arrow B1.

A cartridge case 59Y houses the photoreceptor drum 20Y and surrounding devices 70Y, 90Y, 30Y, and 80Y. The image station 60Y also includes a power supply that applies a primary transfer bias whose polarity is opposite to the charging polarity of the toner to the primary transfer roller 12Y and a driving member that drives the photoreceptor drum 20Y to rotate in the B1 direction.

In the present embodiment, the photoreceptor drum 20Y, the drum cleaning device 70Y, the discharge device 90Y, the charging device 30Y, and the development device 80Y are integrated as a single unit by the cartridge case 59, which forms the image station 60Y, functioning as a process cartridge. The image station 60Y can removed from the image forming body 100 by pulling along a guide rail fixed on the image forming body 100 and can install in the image forming body 100 by pushing the image station 60Y. That is, the image station 60Y is removably installable to the image forming body 100 in the image forming apparatus 1000 as a replaceable part at appropriate timings.

When the image station 60Y (process cartridge) is pushed into the image forming body 100, the image station 60Y is set in a predetermined portion in the image forming body 100, and then, position of the image station 60Y is determined. Thus, by integrating the devices 20Y, 70Y, 90Y, 30Y, and 80Y as the process cartridge, the image station 60Y can be treated as a replacement part, thus maintenance quality is dramatically improved, which is preferable. In addition, by setting life times of the devices in the image station 60Y (elements in the process cartridge) to be set equal, unnecessary replacement can be prevented and eliminated, which is more preferable.

Alternatively, the photoreceptor drum 20Y, and at least one of the drum cleaning device 70Y, the discharge device 90Y, the charging device 30Y, and the development device 80Y may be integrated as a single unit as the process cartridge that is removably attachable to the image forming body 100. Yet alternatively, the image section 60 formed by the four image stations 60Y, 60M, 60C, and 60Bk may be integrated as a single unit as the process cartridge that is removably attachable to the image forming body 100.

The primary transfer roller 12Y and the photoreceptor drum 20Y press against each other via the transfer belt 11, thereby forming a primary transfer nip that is a position where the toner image on the photoreceptor drum 20Y is transferred onto the transfer belt 11. A power supply applies the primary transfer bias controlled at a constant voltage to the primary transfer roller 12Y. The primary transfer member is not limited to the above-described roller type. For example, a conductive charging brush and a corona charger may be used as the primary transfer member instead of the primary transfer roller 12Y.

The discharging device 90Y includes a discharge lamp, positioned adjacent to the surface of the photoreceptor drum 20Y, which electrically cleans (discharges) the surface of the photoreceptor drum 20Y, thereby initializing an electronic potential of the surface of the photoreceptor drum 20Y.

The charging device 30Y includes a charging roller, serving as a charger that contacts the surface of the photoreceptor drum 20Y and is rotated dependently as the photoreceptor drum 20Y rotates, and a cleaning roller serving as a charging cleaner that contacts the charging roller and is rotated dependently as the charging roller rotates.

A charging bias applying device to apply a charging bias to the charging roller is connected to the charging roller. For example, the charging bias is formed by superpositioning (simultaneously supplying) an alternating current component on a direct current component. After the surface of photoreceptor drum 20Y is discharged by the discharging device 90Y, the surface of photoreceptor drum 20Y is charged by the charging roller at predetermined polarity in a charging region positioned facing the charging roller.

The cleaning roller in the charging device 30Y cleans the charging roller by rotating dependently on the rotation of the charging roller. Herein, although the charging device 30Y adapts a charging system using the contact rollers, the charging system may use a proximity roller or non-contact scorotron charger instead of the contact rollers.

As illustrated in FIG. 2, the development device 80Y includes a development roller 81Y positioned adjacent to the photoreceptor drum 20Y, a bias applying device, a toner cartridge to contain the toner, a toner concentration detector, and a toner replenishing device. The development roller 81Y functions as a development member to bear the two-component developer consisting essentially of toner and a magnetic carrier. The bias applying device applies a developing bias to the development roller 81Y. The toner concentration detector detects a toner concentration of the developer, that is, a weight percent ratio of the toner to the carrier in the developer, in the development device 80Y. The toner replenishing device supplies the toner from the toner cartridge to the development device 80Y so that a value of a detection signal detected by the toner concentration detector assumes a predetermined target value. The developer, contained in the development device 80Y, essentially consists of the magnetic carrier and yellow color toner whose regular charging polarity is negative. The developing bias is, for example, the direct component voltage, alternating current component, or a bias formed by superpositioning the alternating current component on the direct current component.

Thus, in the image forming process, the charging device 30Y uniformly charges the photoreceptor drum 20Y. Then, the optical writing device 8 irradiates a predetermined portion of the surface of the photoreceptor drums 20Y positioned between the charging device 30Y and the development device 80Y with the respective laser beam so as to expose the surface of the photoreceptor drum 20Y in accordance with the image data from the scanner 300. Subsequently, the development device 80Y supplies the toner to the photoreceptor drum 20Y to visualize the latent image, thus forming yellow color toner images on the photoreceptor drum 20Y.

The drum cleaning device 70Y includes a cleaning blade whose tip contacts the surface of the photoreceptor drum 20Y to scrap off foreign objects, such as, the residual un-transferred toner, the carrier, and paper powder remained on the surface of the photoreceptor drum 20Y, and a waste toner conveyance member to collect the residual un-transferred toner and convey it to the waste toner container. The drum cleaning device 70Y may use a fur brush roller or a magnetic brush cleaner instead of or with the cleaning blade.

In the above-configured image station 60Y, during image formation, as the photoreceptor drum 20Y rotates in the B1 direction, the surface of the photoreceptor drum 20Y is uniformly charged by the charging device 20Y. Then, the electrostatic latent image corresponding to yellow color is formed by attenuating the electric potential in an exposed portion (illuminated portion), where the optical writing device 8 optically writes. The electrostatic latent image is developed with the yellow toner by the development device 80Y, thus forming the yellow toner image. The toner image formed on the photoreceptor drum 20Y is transferred onto the transfer belt 11 by the primary transfer roller 12Y, using the primary transfer electric field and the nip pressure. The unwanted substance including residual un-transferred toner is removed by the drum cleaning device 70Y, as preparation for the subsequent image formation.

Copying Operation in Image Forming Apparatus

Next, a copying operation using the above-described image forming apparatus 1000 is described below. As sheet feeding modes, the image forming apparatus 1000 has a normal mode and a manual feeding mode. When a user makes copies of a document using the image forming apparatus 1000, initially, in the normal mode, the user sets the document on the document tray 401 of the ADF 400. Alternatively, in the manual feeding mode, the user opens the ADF 400, sets the document on the contact glass 301 of the scanner 300 disposed beneath the ADF 400, and then presses the document with the contact glass 301 by closing the ADF 4. Subsequently, the user pushes the start switch. Herein, the document to be set on the ADF 400 is, for example, a sheaf of sheeted document, and the document to be sent on the contact glass 302, for example, one of page on a stapled book. Yet alternatively, when the image forming apparatus 1000 is used as a printer, image formation operation is started after the user selects and inputs image data to form image in the external input device, such as a personal computer (PC) connected to the image forming apparatus 1000.

During this printing operation, in the normal feeding mode, reading document is started when the document is sent to the contact glass 301 in a state in which the document is set on the document tray 401 after the start switch is pushed. Alternatively, in the manual feeding mode, reading document is started when the start switch is pushed in a state in which the document is set on the contact glass 301.

Scanning (reading) the document in the scanner 300 is described below. By pushing the start switch, the first carriage 302 and the second carriage 303 begin moving along a lower surface of the document placed on the contact glass 301. Therefore, the light source in the first carriage 302 emits laser light onto the document, and the minor in the first carriage 302 receives reflected light from the document and reflects the received light to the second carriage 303. Then, the pair of mirrors in the second carriage 303 further reflects the light to the image focusing lens 304. The ray of light passes though the image focusing lens 304 and enters the reading sensor 305, and the contents of the document are read by the reading sensor 305.

Then, the image stations 60Y, 60M, 60C, and 60Bk are operated based on the generated image data or the input image data. Along with the document reading process, the devices in the image forming stations 60Y, 60M, 60C, and 60Bk, the transfer belt unit 10, the secondary transfer roller 17, and the fixing device 6 are activated.

In the above-configured image station 60Y, during image formation, as the photoreceptor drum 20Y rotates in the B1 direction, the surface of the photoreceptor drum 20Y is uniformly charged by the charging device 20Y. Then, the electrostatic latent image corresponding to the yellow color is formed by attenuating the electric potential in an exposed portion (illuminated portion), where the optical writing device 8 optically writes. The electrostatic latent image is developed with yellow toner by the development device 80Y, thus forming the yellow toner image. The toner image formed on the photoreceptor drum 20Y is transferred onto the transfer belt 11 by the primary transfer roller 12Y, using the primary transfer electric field and the nip pressure. The unwanted substance including residual un-transferred toner is removed by the drum cleaning device 70Y, as preparation for the subsequent image formation.

Similarly to the photoreceptor drums 20Y, the other colors of the toner images are suitably formed on the photoreceptor drums 20C, 20M, 20Bk. The toner images on the photoreceptor drum 20Y, 20M, 20C, and 20Bk are subsequently transferred by the primary transfer rollers 12Y, 12M, 12C, and 12Bk onto the transfer belt 11 so that four toner image are superimposed one on another on the surface of the transfer belt 11 at same position. The primary transfer bias whose polarity is opposite to that of the toner is applied to the primary transfer rollers 12Y, 12M, 12C, and 12Bk.

Then, as the transfer belt 11 is rotated in the A1 direction, the respective single-color toner images that are superimposed one on another on the transfer belt 11 are transferred onto the transfer sheet P by the secondary transfer bias (transfer electric field) and nip pressure, thereby forming multiple-color image on the transfer sheet P.

In addition, when the start switch is pushed, one of the sheet feed rollers 203 in the paper bank 201 sends out the transfer sheet P from one of multistage of the sheet cassettes 202 provided in the paper bank 201. The separation roller 204 separates the transfer sheet P one by one and guides the sheet feeding path 206. Then, the sheet transport roller pair 205 guides the transfer sheet P to the sheet conveyance path 27 in the image forming body 100, and the pair of registration rollers 29 stops conveying the transfer sheet P from the sheet conveyance path 27. The registration rollers 29 forward the transfer sheet P to a portion between the transfer belt 11 and the secondary transfer roller 17, timed to coincide with the arrival of the multicolor toner image formed on the intermediate transfer belt 11. This feeding process is started at the same time when the document reading process is started.

The transfer sheet P onto which multicolor image is transferred in the secondary transfer roller 17 is transported to the fixing device 6 by the transport device 5. In the fixing device 6, the four-color toner image thus transferred is fixed on the surface of the transfer sheet P with heat and pressure in the fixing process.

After the fixing process, when the switch pawl 94 is directed up, the transfer sheets P are discharged toward the discharge sheet tray 75 through the discharge path 78 by the pair of discharging sheet rollers 79 and are stacked on the discharge sheet tray 75. Alternatively, when the switch pawl 94 is directed down, after the image is formed on one side of the transfer sheet P, the transfer sheet P is fed to the sheet reverse mechanism 96. The transfer sheet P thus reversed is conveyed to a position facing the secondary transfer roller 17 to form an image on the other side of the transfer sheet P in the duplex printing.

On the other hand, after the primary transfer process, residual toner in the surface of the photoreceptor drums 20Y, 20M, 20C, and 20Bk is removed by the drum cleaning devices 70Y, 70M, 70C, and 70Bk, and then is electrically discharged by the discharge devices 90Y, 90M, 90C, and 90Bk, as preparation for the subsequent image formation. After the secondary transfer process, the intermediate transfer belt 11 reaches a position facing the belt-cleaning device 16, where any toner remaining on the transfer belt 11 is collected by the belt-cleaning device 16, as preparation for subsequent image formation.

Image Density Adjustment in Image Forming Apparatus

Next, image density adjustment in the image forming apparatus 1000 is described below. In order to execute image formation, it is important for good color reproducibility to keep the density of the toner image (that is, image density) formed on the image stations 60Y, 60M, 60C, and 60Bk stable.

Therefore, in the image forming apparatus 1000, separately from normal image formation, the processor 99 executes image density adjustment process control to control image forming conditions at certain predetermined times. For example, process control is executed when the power supply is turned on, or after images are formed on a predetermined number of transfer sheets P, so that the amount of toner attracted onto an image (image density) formed on the image stations 60Y, 60M, 60C, and 60Bk is set properly.

Process control in the image forming apparatus 1000 is described below. The image stations 60Y, 60M, 60C, and 60Bk form image patches as density adjustment patterns for adjusting of the image density of the toner image on the photoreceptor drums 20Y, 20M, 20C, and 20Bk. Then, the respective colors of the image patches are transferred onto different areas of the transfer belt 11. The optical sensor unit 50 optically reads the image patches of each color. The processor 99 then adjusts image forming conditions, for example, output voltages from the voltage applying members in the charging devices 30Y, 30M, 30C, and 30Bk, bias values from bias applying members in the development devices 80Y, 80M, 80C, and 80Bk, and driving of the toner replenishing device, until the density of the image patches thus read reaches the proper image density.

The processor 99 includes an image forming condition controller 99B to control the above-described image forming conditions. The optical sensor unit 50 reads the image patches, generates an output voltage corresponding to the detected image density of the image patches, and outputs the output voltage to the image forming condition controller 99B. The image forming condition controller 99B converts the output voltage into the amount of toner attracted onto the image using the amount of attracted toner conversion algorithm and calculates development ability $\gamma$ at this time and a development start voltage Vk. Then, based on these calculated values, the image forming condition controller 99B controls the voltage applying members in the charging device 30Y, 30M, 30C, and 30Bk to adjust the value of the charging bias, controls the bias applying members in the development devices 80Y, 80M, 80C, and 80Bk to adjust the developing bias, and adjusts the amount of toner supplied from the toner replenishing device to the development devices 80Y, 80M, 80C, and 80Bk to set a target value of toner concentration to be detected by the toner concentration detector in the development devices 80Y, 80M, 80C, and 80Bk.

Configuration of Optical Sensor Unit

Figure 3:
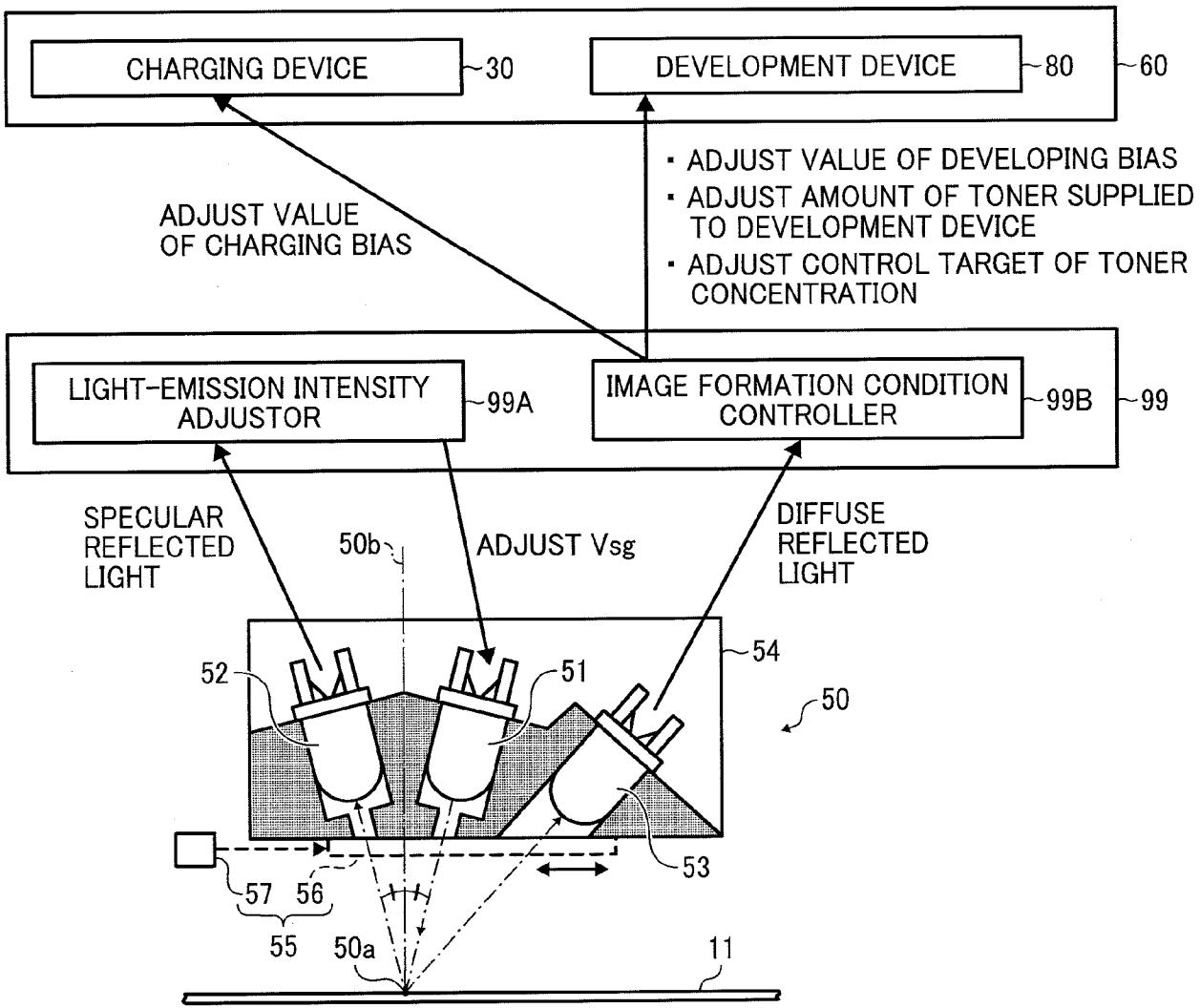
FIG. 3 is a diagram illustrating an optical sensor unit and a processor.

As illustrated in FIG. 3, the optical sensor unit 50 includes a light emitting diode (LED) 51, a specular reflected light receiving element 52, and a diffuse reflected light receiving element 53. The LED 51, serving as a light source, emits an infrared light to the transfer belt 11 to read reflection characteristics of a clear surface of the transfer belt 11 and the image patch formed on the transfer belt 11 during process control. The clear surface (background surface) is a surface of the transfer belt 11 with which the toner is not covered. The receiving elements (P-sensors) 52 and 53 receive light (reflected component) reflected from the transfer belt 11 and the image patch positioned facing the light emitted from the LED 51, respectively. The specular reflected light receiving element 52 serves as a first detector, and the diffuse reflected light receiving element 53 serves as a second detector.

The optical sensor unit 50 further includes a fouling prevention mechanism 55 as a shielding member and an element holder 54. The fouling prevention mechanism shields the LED 51, the specular reflected light receiving element 52, and the diffuse reflected light receiving element 53 to prevent the LED 51, the specular reflected light receiving element 52, and the diffuse reflected light receiving element 53 from being fouled by the toner and keep the LED 51, the specular reflected light receiving element 52, and the diffuse reflected light receiving element 53 performing properly. The element holder 54 holds the LED 51, the specular reflected light receiving element 52, the diffuse reflected light receiving element 53, and the fouling prevention mechanism.

The fouling prevention mechanism includes a shutter 56 and a driving member 57. The shutter 56 moves between a shield position (closed position) in which the LED 51, the specular reflected light receiving element 52, and the diffuse reflected light receiving element 53 are shielded and an open position in which these elements are exposed. The driving member 57 causes the shutter 56 to move between the shield position and the open position. The drive of the driving member 57 is controlled by the processor 99, and the driving member 57 causes the shutter 56 to move the shield position to the open position when the process control is executed.

The specular reflected light receiving element 52 detects a specular reflected component of the reflection component. Therefore, the specular reflected light receiving element 52 is disposed so that an optical axis of the specular reflected light receiving element 52 is positioned symmetrically (opposite side) to an optical axis of the LED 51 based on a normal line

50*b* orthogonal to a point 50*a* through which a light axis of the LED 51 passes on a surface of the transfer belt 11.

The diffuse reflected light receiving element 53 detects a diffuse reflected component of the reflection component. The diffuse reflected light receiving element 53 is disposed on the same side of the LED 51 and is positioned farther away from the normal line 50*b* than the LED 51, and an optical axis of the diffuse reflected light receiving element 53 passes through the point 50*a*.

The specular reflected light receiving element 52 and the diffuse reflected light receiving element 53 are formed by phototransistors or photo diodes. The clear surface of the transfer belt 11 or the image patch formed on the transfer belt 11 functions as a detection object surface, that is, a reflection surface from which the light emitted from the LED 51 is reflected.

Detection of Reflected Light

The specular reflected light receiving element 52 and the diffuse reflected light receiving element 53 function as the detectors to detect intensities of the light reflected from the detection object surface of the transfer belt 11. The detectors 52 and 53 output voltages (output voltages, output signals) in accordance with the intensities of the received reflected light. A light-emission intensity adjustor 99A and the image forming condition controller 99B in the processor 99 then adjust the image forming conditions in accordance with the detected intensities of the reflected light. Herein, the processor 99 (computer) includes a central processing unit (CPU) and associated memory units (e.g., ROM, RAM, etc.). The processor 99 performs various types of control processing by executing programs stored in the memory.

As a precondition to the image forming condition control in which the optical sensor unit 50 optically reads the image patch and the image forming condition controller 99B controls the image forming conditions based on the detected image patch, it is required for setting the image density of the read image patch, that is, the intensities of the received reflected light to appropriate values, to adjust light-emission intensity, that is, light-emission amount (Vsg) of the LED 51 properly (light amount control). In order to achieve this light amount adjustment, it is desirable to adjust the light-emission amount (Vsg adjustment) based on the intensities of the light reflected from the clear surface of the transfer belt 11 whose reflectance of light is relatively stable.

Herein, as a feature of the reflected light detected in the specular reflected light receiving element 52, because the reflected light from the toner on the transfer belt 11 is weakened by the toner, the intensity of the light reflected from the clear surface of the transfer belt 11 is greater than that from the image patch thereon. Conversely, as a feature of the reflected light detected by the diffuse reflected light receiving element 53, because the reflected light from the image patch formed on the transfer belt 11 diffuses by diffusion of the color toner, the intensity of the light reflected from the clear surface of the transfer belt 11 is smaller than that from the image patch thereon.

With these features, in the optical sensor unit 50, the adjustment of light-emission amount (Vsg) is executed based on the intensity of the specular reflected light detected in the specular reflected light receiving element 52, because readings from (output value of) the specular reflected light detected in the diffuse reflected light receiving element 53 is small near the clear surface of the transfer belt 11 and the low output is unsuitable for the adjustment of the light-emission amount (Vsg).

Therefore, in the process control, initially, the specular reflected light receiving element 52 reads the light reflected from the clear surface of the transfer belt 11 which is not covered with toner. The light-emission intensity adjuster 99A of the processor 99 controls the drive of the LED 51 to adjust the light-emission amount of the LED 51 so that readings from the specular reflected light receiving element 52 is set to a predetermined value.

After the adjustment of the light-emission intensity of the LED 51, the diffuse reflected light receiving element 53 reads the light reflected from the image patch formed on the transfer belt 11, and the image forming condition controller 99B controls the image forming conditions so that readings from the diffuse reflected light receiving element 53 assumes a predetermined value. The operation of the adjustment of the light-emission intensity and control of the image forming conditions are described further detail later.

Similarly to the optical sensor unit 50, typically, the specular reflected light is detected by using decrease in the intensity of the reflected light caused by shielding the light emitted to the clear surface of toner carrier (the transfer belt 11) by the toner. Therefore, in order to improve signal to noise ratio (S/N ratio), it is preferable that the specular reflected light from the clear surface of the toner carrier (transfer belt 11) is high and the specular reflected light from the toner thereon is low. On the other hand, the diffuse reflected light is detected by using the increase in the reflected light because the light directed onto the clear surface of the toner carrier diffuses by attracting the color toner onto the toner carrier. Therefore, in order to improve the S/N ratio, it is preferable that the specular reflected light from the clear surface of the toner carrier is low and the diffused reflected light from the toner thereon is low. Accordingly, in both the detections of the specular reflected light and diffused reflected light, it is preferable that the surface of the toner carrier (transfer belt 11) be smooth and glossy.

Configuration of Transfer Belt

Figure 4:
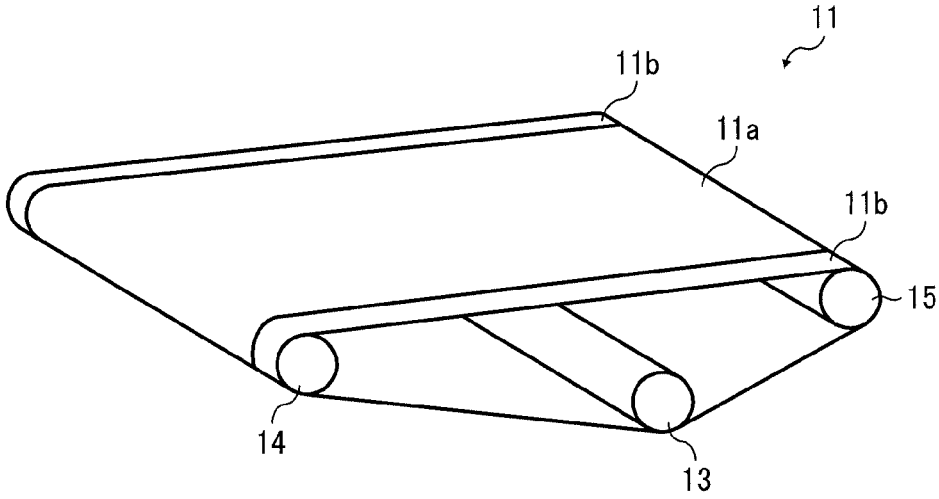
FIG. 4 is a perspective diagram illustrating an intermediate transfer member in the transfer belt unit.

In the present image forming apparatus 1000, as illustrated in FIG. 4, the transfer belt 11 includes a carrier portion 11*a* and a glossy portion 11*b* whose glossiness is higher than that of the carrier portion 11*a*. The carrier portion 11*a*, serving as a first portion, carries the toner image to be transferred onto the transfer sheet P by the secondary transfer roller 17. The glossy portion 11*b*, serving as a second portion, is positioned outside of an operation area of the secondary transfer roller 17, that is, outside of the transfer region.

In the present embodiment, the carrier portion 11*a* occupies a center portion of the transfer belt 11 in a width direction (main scanning direction) of the transfer belt 11, and the glossy portions 11*b* are positioned on both sides of the carrier portion 11*a* at lateral edges of the transfer belt 11. The transfer performance of the toner image onto the transfer sheet P is ensured, because the glossy portion 11*b* corresponds to an area outside of a transfer region (operation region of the secondary transfer roller 17) and the toner image carried on the carrier portion 11*a* is transferred onto the transfer sheet P. In the present embodiment, the width of the transfer belt 11 is, for example, 376 mm, and at this time, the width of the glossy portion 11*b* is, for example, within a range from 20 mm to 50 mm.

In the width direction of the transfer belt 11, the secondary transfer roller 17 is of the same width as the carrier portion 11*a* of the transfer belt 11, and the secondary transfer roller 17 is positioned facing the carrier portion 11*a*. With this configuration, the adverse effect caused by difference in flattened amount of the transfer belt 11 in the secondary transfer nip due to the use of different materials for the carrier portion 11*a* and the glossy portion 11*b* can be avoided.

Alternatively, it is to be noted that the image stations 60Y, 60M, 60C, 60Bk including the photoreceptor drums 20Y, 20M, 20C, and 20BK may form images onto not only the carrier portion 11*a* in the width direction of the transfer belt 11 but also the glossy portion 11*b*. In this case, the belt-cleaning device 16 can clean not only the carrier portion 11*a* but also the glossy portion 11*b* of the transfer belt 11.

In the present embodiment, the image forming apparatus 1000 includes multiple optical sensor units 50. For example, multiple optical sensor units 50 are positioned with respect to the carrier portion 11*a* in the width direction of the transfer belt 11, and single optical sensor unit 50 is positioned with respect to the glossy portion 11*b*.

Figure 5A:
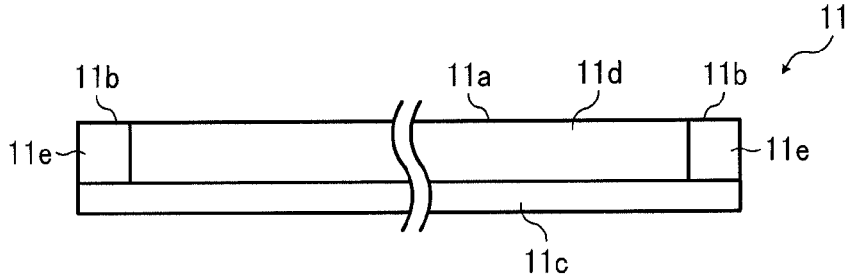
FIG. 5A is a cross-sectional diagram illustrating the intermediate transfer member.
Figure 5B:
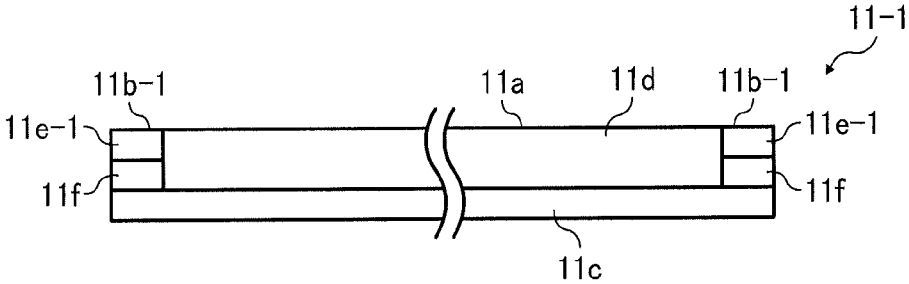
FIG. 5B is a cross-sectional diagram illustrating a variation structure of the intermediate transfer member.

Next, a detail configuration of the transfer belt 11 is described below with reference to FIGS. 5A and 5B. Both configurations illustrated in FIGS. 5A and 5B can be used in the transfer belt 11 in the present disclosure. FIGS. 5A and 5B are cross-sectional diagrams illustrating the transfer belt 11 in a direction orthogonal to the A1 direction.

In common configurations of FIGS. 5A and 5B, the transfer belt 11 (11-1) includes a base layer 11*c* that constitutes main body as an internal layer, an elastic layer 11*d* whose surface forms the carrier portion 11*a*, and a high-gloss layer 11*e* (11*e*-1) whose surface forms the glossy portion 11*b* (11*b*-1), constituted by polyimide resin, and positioned on both sides of the elastic layer 11*d*.

In these configurations, the transfer belt 11 has an advantage that is available of keeping transfer performance due to deformation when the transfer sheet P has asperity, because the transfer belt 11 includes the elastic layer 11*d*. Since the glossy portion 11*b* is formed of the polyimide resin, the transfer belt 11 has an advantage that is less likely to be scraped, the glossiness can be kept, and it is high durability. It is preferable that the glossy portion 11*b* have the glossiness, for example within a range around 80 through 200 when the glossiness is detected by a glossmeter PG-1, manufactured by Nippon denshoku industry, in terms of the adjustment of the light-emission amount of the LED 51.

In a configuration illustrated in FIG. 5A, after the elastic layer 11*d* is formed on a center portion of the base layer 11*c*, the high-gloss layer 11*e* is formed by applying a polyimide resin coating material to the both sides of the elastic layer 11*d* while a surface of the elastic layer 11*d* is masked.

In a configuration illustrated in FIG. 5B, a transfer belt 11-1 further includes a seal material 11*f* positioned between the base layer 11*c* and the high-gloss layer 11*e*-1. In this configuration, after the elastic layer 11*d* is formed on the center portion of the base layer 11*c*, the high-gloss layer 11*e*-1 is formed by sealing a high-gloss material on the base layer 11*c* with the seal material 11*f* on the both sides of the elastic layer 11*d*.

In the present embodiment, the base layer 11*c* has a thickness of 60 μm. The elastic layer 11*d* has a thickness of 150 μm, but a value ranging from 50 μm to 500 μm is acceptable.

The high-gloss layer 11*e* is of the same thickness as the elastic layer 11*d* in the configuration illustrated in FIG. 5A, and the sum of the thickness of the high-gloss layer 11*e*-1 and the seal material 11*f* is identical to the thickness of the elastic layer 11*d* in the configuration illustrated in FIG. 5B. With these configurations, the position of the surface of the glossy portion 11*b* is equal to that of the surface of the carrier portion 11*a*. Therefore, when the toner images on the photoreceptor drums 20Y, 20M, 20C, and 20Bk are transferred onto the transfer belt 11 and when the belt-cleaning device 16 cleans the transfer belt 11, transfer performance and cleaning performance in the carrier portion 11*a* and the glossy portion 11*b* can be made uniform.

It is to be noted that, in a case in which it is necessary to ensure bulky thickness in the elastic layer 11*d*, the configuration illustrated in FIG. 5B has an advantage that, even if making the high-gloss layer 11*e*-1 whose thickness is equal to that of the elastic layer 11*d* is difficult due to difficulties from limitation placed on the material type of the high-gloss layer 11*e*, the limitation of the thickness of the high-gloss layer 11*e* can be solved or alleviated by adjusting the thickness of the seal material 11*f* and sticking the high-gloss layer 11*e*-1 with the thickness-adjusted sealing material 11*f*.

Alternatively, the transfer belt 11 may be manufactured by different ways from above-described ways. For example, the elastic layer 11*d* is formed on entire surface of the base layer 11*c*, that is, the elastic layer 11*d* is formed on a portion on which the glossy portion 11*b* is formed, and a thickness of the portion of the elastic layer 11*d* corresponding to the glossy portion 11*b* is set thinner than the portion corresponding to the carrier portion 11*a*. Then, similarly, the high-gloss layer 11*e* may be formed by applying the high-gloss coating material illustrated in FIG. 5A or sealing the high-gloss material with the seal member 11*f* illustrated in FIG. 5B.

Process Control

Figure 6:
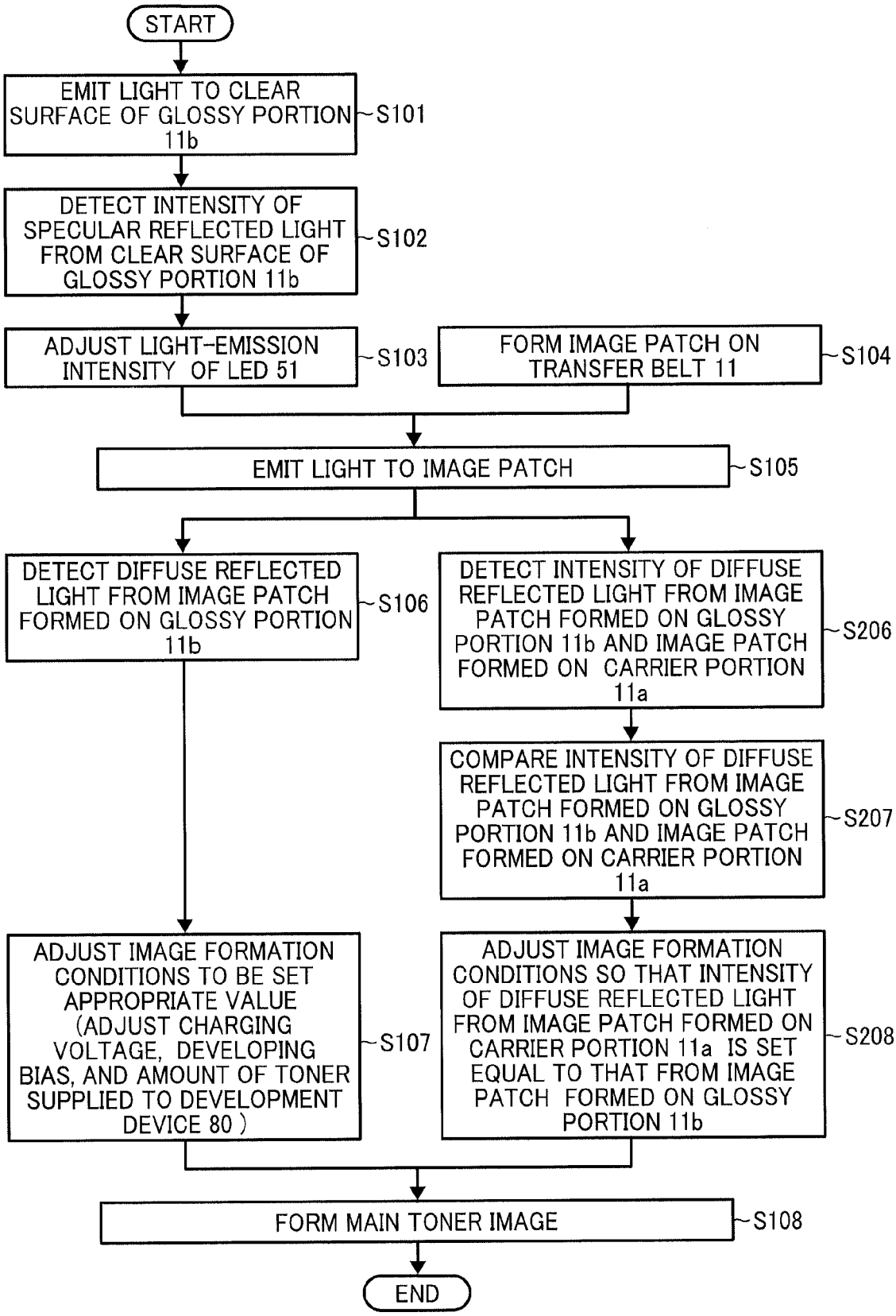
FIG. 6 is a flowchart illustrating steps in a process control of the image forming apparatus shown in FIG. 1.

Next, a detail operation of the process control using the above-configured the transfer belt 11 is described below, with reference to FIG. 6. FIG. 6 is a flowchart illustrating steps in the process control of the image forming apparatus 1000. The processor 99 includes RAM that stores image density control program, serving as a control program of the process control. When the execution of the image density control program is started, the shutter 56 of the fouling prevention mechanism 55 is moved from the shield position to the open position.

First Stage of Process Control

Initially, at step S101, the light-emission intensity adjuster 99A drives the LED 51 positioned corresponding to the glossy portion 11*b* to emit light to the clear surface of the glossy portion 11*b* of the transfer belt 11. Then, at step S102, the specular reflected light receiving element 52 detects the intensity of the specular reflected light from the clear surface of the glossy portion 11*b* of the transfer belt 11 and outputs the output voltage corresponding to the detected intensity of the specular reflected light to the light-emission intensity adjuster 99A.

Subsequently, the light-emission intensity adjuster 99A of the processor 99 adjusts the light-emission intensity, in other words, the driving voltage of the LED 51 so that the output voltage from the specular reflected light receiving element 52 is set to 4.0 V. This 4.0 V is the value as the proper value that the diffuse reflected light receiving element 53 reads the image patch and the image forming condition controller 99B controls the image forming conditions, stored in advance, other setting values are adaptable for the readings from (output voltage of) the diffuse reflected light receiving element 53 as long as the image forming conditions is controlled successfully.

Thus, at step S103, the light-emission intensity adjuster 99A adjusts the light amount Vsg of the LED 51 based on the output voltage corresponding to the clear surface of the glossy portion 11*b*, and therefore, the adjustment of the light amount (Vsg) is performed well at high degrees of accuracy.

More specifically, the light-emission intensity adjuster 99A drives the LED 51 of the optical sensor unit 50 corresponding to the carrier portion 11*a*, using the driving voltage of the LED 51 corresponding to the glossy portion 11*b* that is determined by the above-described the light amount adjustment (Vsg). Further, providing the fouling prevention mechanism 55 in the optical sensor unit 50, the light-emission intensities of all LED 51 are set to almost identical. Therefore, even though the reflectance of the carrier portion 11*a* is low and the adjustment accuracy is low when the light amount (Vsg) is adjusted based on the reflected light from the carrier portion 11*a*, the adjustment of the light amount (Vsg) of the LED 51 in the optical sensor unit 50 corresponding to the carrier portion 11*a* is performed well.

Second Stage of Process Control

Along with the adjustment of the light amount (Vsg), at step S104, the image stations 60Y, 60M, 60C, and 60Bk form respective colors of the image patches on the photoreceptor drums 20Y, 20M, 20C, and 20BK, and then the image patches are independently transferred onto the corresponding portions of the transfer belt 11, positioned facing to the optical sensor unit 50, in the width direction of the transfer belt 11.

After the adjustment of the light amount (Vsg) of the LED 51, the LED 51 emits light to the image patches formed on the glossy portion 11*b* of the transfer belt 11 based on the intensity of the reflected light detected by the specular reflected light receiving element 52 at S105. Then, at S106, the diffuse reflected light receiving element 53 in the optical sensor unit 50 detects the diffuse reflected light reflected from the respective colors of the image patches carried on the glossy portion 11*b*, and outputs the output voltage that corresponds to the diffuse reflected light from the image patches to the image forming condition controller 99B.

At S107, the image forming condition controller 99B adjusts the image forming conditions in the image stations 60Y, 60M, 60C, and 60Bk based on the intensity of the diffuse reflected light detected by the diffuse reflected light receiving element 53, during the main image formation after the process control, to form the respective toner images successfully. More specifically, the image forming condition controller 99B sets the image forming conditions in the image stations 60Y, 60M, 60C, and 60Bk so that, if the diffuse reflected light receiving element 53 detects toner image formed during the main image formation after the process control, the output voltage detected by the diffuse reflected light receiving element 53 is set to an appropriate value.

After the process control is completed, the toner image to be transferred onto the transfer sheet P is formed as the main image formation at step S108. In the following main image formation, the image forming condition controller 99B controls the image stations 60Y, 60M, 60C, and 60BK, using the thus-determined image forming conditions.

Variation of Second Stage of Process Control

In addition, as a variation, following image density control method is acceptable.

Although the diffuse reflected light receiving element 53 detects the image patches formed on the glossy portion 11*b* as described above, in this control, the diffuse reflected light receiving element 53 detects the intensity of the diffuse reflected light from the image patches on both the glossy portion 11*b* and the carrier portion 11*a* at step S206 in FIG. 6. Herein, the diffuse reflected light receiving element 53 of the optical sensor unit 50 positioned near the carrier portion 11*a* to detect the reflected light from the carrier portion (first portion) 11*a* serves as an additional second detector.

In this control, the intensities of the diffuse reflected light from (image density of) the image patches formed on the glossy portion 11*b* and the carrier portion 11*a* detected by the diffuse reflected light receiving element 53 are input to the image forming condition controller 99B. At step S207, the image forming condition controller 99B compares the intensities of the diffuse reflected light from the image patch formed on the glossy portion 11*b* with that from the image patch formed the carrier portion 11*a*. Then, at step S208, the image forming condition controller 99B controls the image forming conditions (adjusts the values of the charging bias and developing bias, the amount of toner supplied to the development devices 80, the control target of the toner concentration in the development device 80Y) so that the image density (the intensity of the diffuse reflected light) of the image patch formed on the carrier portion 11*a* becomes equal to the image density of the image patch on the glossy portion 11*b*.

After the process at S208 is finished, that is, the process control of this variation is completed, the toner image to be transferred onto the transfer sheet P is formed as the main image formation at step S108.

Thus, in the process control, the light-emission intensity of the LED 51 is adjusted with a high degree of accuracy, and then the image forming conditions in the image stations 60Y, 60M, 60C, and 60Bk are controlled by using the adjusted light emission intensity of the LED 51, so that the main image formation after the process control is executed at high quality.

It is to be noted that the image patch formed on the transfer belt 11 during the process control is cleaned by the belt-cleaning device 16, not only the area corresponding to the carrier portion 11*a* but also the area corresponding to the glossy portion 11*b*.

As described above, the ROM in the processor 99 stores the image density control program to execute the image density control method. The image density control method including emitting light to the glossy portion (second portion) 11*b* of the transfer belt 11 (intermediate transfer member) 11, from the LED (light source) 51; detecting intensity of light reflected from the second portion 11*b* of the intermediate transfer member 11 by the specular reflected light receiving element (first detector) 52; adjusting light-emission intensity emitted from the light source 51 based on the intensity of the reflected light detected by the first detector 52; forming an image patch (density adjustment pattern) on the intermediate transfer member 11; emitting light onto the density adjustment pattern formed on the intermediate transfer member 11, from the light source 51; detecting intensity of light reflected from the density adjustment pattern formed on the intermediate transfer member 11 by the diffuse reflected light receiving element (second detector) 53, after the light-emission intensity from the light source 51 is adjusted; and adjusting image forming conditions to form the toner image on the photoreceptor drum (image carrier) 20 based on the intensity of the light reflected from the density adjustment pattern formed on the intermediate transfer member 11 detected by the second detector 53.

The ROM in the processor 99 functions as an image density control storage device. However, the image density control program is not limited to be stored in the ROM in the processor 99, the image density control program can be stored in semiconductor media (e.g., random access memory (RAM), and nonvolatile memory), optical media (e.g., DVD, MP, MD, CD-R), optical media (e.g., hard desk, magnetic tape, flexible desk), and other storage media. When the image density control program is stored in these storage memories and media, the image density control program is readable by the computer.

In addition, the material and shape of the transfer belt 11 are not limited to the above-described embodiment, and various modifications and improvements in the material and shape of the transfer belt are possible without departing from the spirit and scope of the present invention.

For example, although the second portions (glossy portions) 11*b* are not limited at the lateral edges of the transfer belt 11 in the main scanning direction, the second portion may be positioned at only one side edge of transfer belt 11 in the main scanning direction. However, in a configuration in which the second portions are provided at both lateral edges, the image patches can be detected in half time, comparing to a configuration in which the second portion 11*b* is positioned at only one side edge of the transfer belt 11. More specifically, when the image patches for yellow and cyan are formed on one side of the second portions 11*b* along the A1 direction (see FIG. 2), the image patches for magenta and black are formed on the other side of the second portion 11*b* along the A1 direction, and the two detectors can detect the respective colors of the image patches. Therefore, this configuration can detect in half time, comparing to the configuration in which all color of the image patches are arranged in one line in one side of the second portion 11*b* along the A1 direction.

In addition, the configuration illustrated in FIG. 4 has additional advantage that, in case in which the image patch in one side of the second portions (glossy portion) 11*b* cannot be detected for some reason, by forming the respective color of the image patches on the other side of the second portions, all color of the image patches can be detected.

Alternatively, the second portion may be provided on the way to intermediate transfer member 11 in the sub-scanning direction. With this configuration, communalizing the detectors to detect the first stage of the process control to determine the light amount (Vsg) of the LED 51 based on the intensity of light detected by the specular reflected light receiving element 52, and the second stage of the process control to control the image forming conditions in the image stations 60Y, 60M, 60C, and 60Bk based on the diffuse reflected light receiving element 53, the number of the light source and the detectors is further eliminated than the configuration in which the second portions are positioned at the both lateral edges of the transfer belt 11. However, in this case, by adjusting driving timing of the secondary transfer roller 17, for example, stopping the transfer operation to transfer the image carried on the transfer belt 11 onto the transfer sheet P while the second portion is passed through the secondary transfer nip, the second portion can be practically positioned outside of the operation area of the secondary transfer roller 17.

Although the above description concerns a multicolor image forming process, the image forming apparatus 1000 can form single-color images using one of four image stations 60Y, 60M, 60C, and 60Bk, or two or three color images using two or three of them. Although the developer using the present image forming apparatus is not limited to the two-component developer, but one-component developer can be used if the image forming apparatus can adapt cleaning-less configuration.

It is to be noted that the configuration of the present specification is not limited to that shown in FIG. 1. For example, the configuration of the present specification may be adapted to printers including an electrophotographic image forming device as well as other types of image forming apparatuses, such as copiers, facsimile machines, multifunction peripherals (MFP), and the like.

Numerous additional modifications and variations are possible in light of the above teachings. It is therefore to be understood that, within the scope of the appended claims, the disclosure of this patent specification may be practiced otherwise than as specifically described herein.

What is claimed is:

1. An image forming apparatus to form a toner image onto a recoding medium, comprising:

an image carrier to bear the toner image and a density adjustment pattern for adjusting image density of the toner image;

an intermediate transfer member on which the toner image and the density adjustment pattern are formed, having a first portion and a second portion, the second portion having a higher glossiness than that of the first portion;

a primary transfer member to transfer the toner image and the density adjustment pattern from the image carrier onto the intermediate transfer member;

a light source to emit light onto the intermediate transfer member and the density adjustment pattern formed on the intermediate transfer member;

a detector to detect intensity of reflected light emitted from the light source and then reflected from the intermediate transfer member and the density adjustment pattern formed on the intermediate transfer member; and a processor comprising:

a light-emission intensity adjuster to adjust light-emission intensity of light emitted from the light source based on detected intensity of light reflected from the second portion of the intermediate transfer member; and an image forming condition controller to control image forming conditions for forming the toner image based on the detected intensity of the light reflected from the density adjustment pattern formed on the intermediate transfer member.

2. The image forming apparatus according to claim 1, wherein the image forming conditions include output voltage from a voltage applying member in a charging device, a bias value from bias applying member in a development device, and the amount of toner supplied from a toner replenishing device.

3. The image forming apparatus according to claim 1, further comprising:

a secondary transfer member to transfer the toner image on the first portion of the intermediate transfer member onto the recording medium, wherein the second portion of the intermediate transfer member corresponds to an area outside of a transfer area of the secondary transfer member at which the secondary transfer member transfers the toner image on the first portion of the intermediate transfer member onto the recording medium.

4. The image forming apparatus according to claim 1, wherein the intermediate transfer member is an endless belt.

5. The image forming apparatus according to claim 4, wherein the first portion of the intermediate transfer member comprises an elastic layer.

6. The image forming apparatus according to claim 4, wherein the first portion is the center of the belt and the second portion is lateral edges of the belt in a width direction.

7. The image forming apparatus according to claim 4, wherein the belt comprises a base layer and the second portion is a high-gloss coating material applied to the base layer.

8. The image forming apparatus according to claim 4, wherein the belt comprises a base layer and the second portion is a high-gloss material sealed on the base layer.

9. The image forming apparatus according to claim 1, wherein the second portion of the intermediate transfer member is a polyimide resin.

10. The image forming apparatus according to claim 1, wherein the detector is an optical detector comprising:

a first detector to detect the intensity of the light reflected from the second portion of the intermediate transfer member; and a second detector to detect the intensity of the light reflected from the density adjustment pattern formed on the intermediate transfer member, wherein the light-emission intensity adjuster adjusts the light-emission intensity of light emitted from the light source based on the intensity of the reflected light detected by the first detector, and the image forming condition controller adjusts the image forming conditions based on the intensity of the reflected light detected by the second detector, after the light-emission intensity from the light source is adjusted based on the intensity of the reflected light detected by the first detector.

11. The image forming apparatus according to claim 10, wherein the first detector is a specular reflected light receiving element to detect intensity of specular reflected light from the second portion of the intermediate transfer member, and the second detector is a diffuse reflected light receiving element to detect intensity of diffuse reflected light from the density adjustment pattern formed on the intermediate transfer member.

12. The image forming apparatus according to claim 10, wherein the second detector detects intensity of light reflected from the density adjustment pattern formed on the second portion of the intermediate transfer member.

13. The image forming apparatus according to claim 10, further comprising an additional second detector, wherein the second detector detects intensity of light reflected from the density adjustment pattern formed on the second portion of the intermediate transfer member, the additional second detector detects intensity of light reflected from the density adjustment pattern formed on the first portion of the intermediate transfer member, the image forming condition controller compares the intensities of the light reflected from the density adjustment pattern formed on the second portion with that from the density adjustment pattern formed on the first portion, and the image forming condition controller adjusts the image forming conditions so that the intensity of the light reflected from the density adjustment pattern formed on the first portion is set equal to that from the density adjustment pattern formed on the second portion.

14. The image forming apparatus according to claim 10, further comprising:

a charging device to apply a charging voltage to the image carrier; and a development device to apply a developing bias to develop a latent image and a latent image adjustment pattern formed on the image carrier with developer consisting essentially of toner and carrier particles to make the toner image and the density adjustment pattern, having a toner replenishing device to supply the toner to the development device, wherein the image forming condition controller adjusts the charging voltage in the charging device and the developing bias in the development device and the amount of toner supplied to the development device to adjust the image density of the toner image on the image carrier based on the intensity of the reflected light detected by the second detector.

15. The image forming apparatus according to claim 14, wherein the density adjustment pattern is formed separately from formation of a main toner image.

16. An image density control method in an image forming apparatus comprising an image carrier, an intermediate transfer member having a first portion and a second portion that has higher glossiness than that of the first portion, a primary transfer member, a light source, a first detector, and a second detector, the image density control method comprising:

emitting light to the second portion of the intermediate transfer member, from the light source;

detecting intensity of light reflected from the second portion of the intermediate transfer member by the first detector;

adjusting light-emission intensity emitted from the light source based on the intensity of the light reflected from the second portion of the intermediate transfer member and detected by the first detector;

forming a density adjustment pattern on the intermediate transfer member;

emitting light onto the density adjustment pattern formed on the intermediate transfer member, from the light source;

detecting intensity of light reflected from the density adjustment pattern formed on the intermediate transfer member by the second detector, after the light-emission intensity from the light source is adjusted; and adjusting image forming conditions to form a toner image on the image carrier based on the intensity of the light reflected from the density adjustment pattern formed on the intermediate transfer member and detected by the second detector.

17. The image density control method according to claim 16, wherein adjusting image forming conditions comprising:

adjusting a charging voltage in a charging device;

adjusting a developing bias in a development device; and adjusting the amount of toner supplied to the development device, to control the image density of the toner image formed on the image carrier, based on the intensity of the reflected light detected by the second detector.

18. The image density control method according to claim 16, further comprising:

detecting intensity of light reflected from the density adjustment pattern formed on the second portion of the intermediate transfer member, after the light-emission intensity emitted from the light source is adjusted based on the intensity of the reflected light detected by the first detector;

detecting intensity of light reflected from the density adjustment pattern formed on the first portion of the intermediate transfer member;

comparing the intensities of the light reflected from the density adjustment pattern formed on the second portion with that from the density adjustment pattern formed on the first portion; and adjusting the image forming conditions so that the intensity of the light reflected from the density adjustment pattern formed on the first portion is set equal to that from the density adjustment pattern formed on the second portion.

* * * * *